US006267056B1

(12) United States Patent
Kolbe et al.

(10) Patent No.: US 6,267,056 B1
(45) Date of Patent: Jul. 31, 2001

(54) PRINTING MACHINE

(75) Inventors: Wilfried Kolbe, Gülzow; Klaus Schirrich, Bielefeld; Manfred Terstegen, Bielefeld; Bodo Steinmeier, Bielefeld, all of (DE)

(73) Assignee: Fischer & Krecke GmbH & Co., Bielefeld (DE)

( * ) Notice: Subject to any disclaimer, the term of this patent is extended or adjusted under 35 U.S.C. 154(b) by 0 days.

(21) Appl. No.: 09/431,473

(22) Filed: Nov. 1, 1999

(30) Foreign Application Priority Data

Nov. 6, 1998 (EP) ..... 98121059

(51) Int. Cl.[7] ..... B41F 13/008
(52) U.S. Cl. ..... 101/480; 101/375
(58) Field of Search ..... 101/480, 389.1, 101/479, 375

(56) References Cited

U.S. PATENT DOCUMENTS

| | | | | |
|---|---|---|---|---|
| 2,138,179 | | 11/1938 | Lang | 101/153 |
| 4,058,059 | * | 11/1977 | Moestue | 101/168 |
| 5,152,222 | * | 10/1992 | Okamura et al. | 101/211 |
| 5,365,845 | * | 11/1994 | Becker | 101/230 |
| 5,490,458 | * | 2/1996 | Stuart | 101/375 |
| 5,638,754 | | 6/1997 | Steinmeier et al. | 101/477 |
| 5,685,226 | * | 11/1997 | Fuller | 101/216 |
| 5,832,829 | | 11/1998 | Kolbe et al. | 101/352.01 |
| 5,906,162 | | 5/1999 | Kolbe et al. | 101/352.01 |
| 6,019,036 | * | 2/2000 | Ohkawa | 101/116 |
| 6,175,705 | * | 1/2001 | Harada et al. | 399/117 |

FOREIGN PATENT DOCUMENTS

| | | |
|---|---|---|
| 2262720 | 7/1974 | (DE) . |
| 19530283 | 10/1996 | (DE) . |
| 19624394 | 12/1997 | (DE) . |
| 19647919 | 5/1998 | (DE) . |
| 0769373 | 4/1997 | (EP) . |
| 0962316 | 12/1999 | (EP) . |
| 55-52080 * | 4/1980 | (JP) . |

* cited by examiner

*Primary Examiner*—Daniel J. Colilla
(74) *Attorney, Agent, or Firm*—Richard M. Goldberg

(57) ABSTRACT

A printing machine with a cylinder sleeve (16), which can be rotationally driven and is supported at both ends with protruding axle journals (18) directly in the machine frame (10, 12), and with a shaft (22), which passes through the cylinder sleeve and can be driven along with it, such that the rotational driving takes place over the shaft (22) and the cylinder sleeve (16) can be set axially against a torque transfer element (28), which is seated on the shaft.

18 Claims, 1 Drawing Sheet

PRINTING MACHINE

BACKGROUND OF THE INVENTION

The invention relates to a printing machine with a cylinder sleeve, which can be rotationally driven and is supported at both ends with protruding axle journals directly in the machine frame, and with a shaft, which passes through the cylinder sleeve and can be driven along with it.

A printing machine of this type is disclosed by the EP-A-0 769 373. For this printing machine, the shaft is clamped boom-like in the machine frame, so that, for exchanging printing cylinders, the cylinder sleeve can be pulled off axially from the free end of the shaft, after the bearings for the cylinder sleeve are opened and the unit of shaft and cylinder sleeve has been lifted out of the bearings. The printing cylinder sleeve is driven over a gearwheel, which meshes with a driving gearwheel and is disposed on an extension of the axle journal of the cylinder sleeve.

SUMMARY OF THE INVENTION

It is an object of the invention to provide a printing machine of the type named above, which permits the cylinder sleeve, especially the printing cylinder sleeve, to be exchanged easily and with which the printing cylinder sleeve can be driven directly by means of a driving motor disposed coaxially to it.

Pursuant to the invention, this objective is accomplished owing to the fact that the rotational driving is accomplished over the shaft and the cylinder sleeve can be set axially against a torque transfer element, which is seated on the shaft.

The shaft thus functions not only for supporting the cylinder sleeve during the exchange of cylinders, but also, at the same time, as a driving shaft. Accordingly, it is possible to couple the motor to the driving shaft, without interposing a gear drive. When cylinders are exchanged, the driving connection between the motor and the shaft need not be interrupted. Since the driving torque is transferred from the shaft to the cylinder sleeve simply by axially setting the cylinder sleeve against the torque transfer element, no special measures are required when exchanging cylinders in order to interrupt and restore the driving connection between the shaft and the cylinder sleeve. When the cylinder sleeve is pulled off from the shaft, the driving connection is interrupted automatically and, when the cylinder sleeve once again is pushed axially onto the shaft and reaches its end position on the shaft, it is set once again against the torque transfer element, so that the driving torque can be transferred once more to the cylinder sleeve.

The invention is not limited to the driving mechanism for the printing cylinder sleeve and can be used generally for exchangeable and rotationally driven rotating objects of a printing machine, for example, also for engraved ink transfer rollers and screen rollers of a flexographic printing press and the like.

The direct mounting of the cylinder sleeve in the machine frame has the advantage that the axis of rotation of the cylinder sleeve is defined precisely. Accordingly, it can be achieved that the printing machine runs quietly and the printing quality is perfect. Since, however, pursuant to the invention, the cylinder sleeve is driven over the shaft, which in turn must be supported in the machine frame, it is advisable to configure the support of the shaft and/or of the coupling between the shaft and the cylinder sleeve in such a manner, that redundancies of the axis of rotation are avoided and, accordingly, the axis of rotation of the cylinder sleeve continues to be determined primarily by the mounting of the axle journals in the machine frame. This can be achieved, for example, by mounting the shaft flexibly in the radial direction in the machine frame. If the shaft is coupled rigidly with the rotor of the driving motor, then this means that the rotor of the driving motor or the whole of the driving motor is also held flexibly in the radial direction at the machine frame. This can be achieved, for example, by a construction of the holding mechanism for the motor, which has a certain elasticity in the radial direction of the shaft. The torque transfer element between the shaft and the printing cylinder sleeve can then be constructed, for example, as a cone, which engages a counter-cone at the cylinder sleeve frictionally. When the cylinder sleeve is set axially against the cone, the shaft is centered in this manner on the axis of rotation defined by the axle journal of the cylinder sleeve.

In a different embodiment, the torque transfer element is constructed as a flat friction disk, which interacts with an end face of an axle journal of the cylinder sleeve. A friction coupling, so designed, offers the possibility of compensating for a slight eccentricity in the shaft in relation to the axis of rotation of the cylinder sleeve. In this case, the shaft can therefore also be mounted rigidly in relation to the machine frame.

The two solutions, which are described above and for which the cylinder sleeve is clamped with a relatively high force axially against the torque transfer element, so that a frictional transfer of torque is achieved, at the same time have the advantage that an axially fixed connection is created between the cylinder sleeve and the shaft. By these means, the advantageous possibility opens up of also adjusting the lateral register by way of the shaft. If the shaft is driven directly, it is, however, also necessary to ensure that, in this case, an axial adjustment of the shaft is possible while the driving connection between the shaft and the motor is maintained. This can be achieved, for example, owing to the fact that the rotor of the motor can be adjusted axially relative to the stator. The rotor can then be coupled rigidly with the shaft or constructed in one piece with the latter and participates in the axial movement of the shaft when the lateral register is adjusted. A further possibility consists of providing an axial coupling between the rotor of the motor and the shaft. In this case, during the adjustment of the lateral register, only the shaft is adjusted in the axial direction, whereas the rotor retains its axial position and the relative movement between the shaft and the rotor is compensated for by the axial coupling. Finally, it is also possible to support the whole of the motor housing so that it can be moved axially at the machine frame so that, when the lateral register is adjusted, the cylinder sleeve, the shaft and the motor are moved as a unit.

With respect to a simple and accurate adjustment of the longitudinal register, it is desirable that the cylinder sleeve can be coupled in a defined angular position with the shaft, so that the respective shaft angular position of the cylinder sleeve can be determined automatically with the help of an angular increment pick-up, which is disposed on the shaft or can be attached to the motor or integrated in the motor. For this purpose and, in accordance with a further development of the invention, at least one engaging dog is disposed at the torque transfer element or at the corresponding counter-surface at the cylinder sleeve and falls into a corresponding contour of the respectively other component, when the cylinder sleeve is set axially against the torque transfer element. In the peripheral direction, the engaging dog should engage the counter-contour without clearance, so that the angular position of the cylinder sleeve can be determined precisely. If the torque transfer element is constructed as a flat friction disk, the engaging dog and the counter-contour should, however, be movable in the radial direction relative to one another, so that it remains possible to compensate for the eccentricity between the shaft and the cylinder sleeve. Admittedly, owing to the fact that the engaging dog engages the counter-contour, there is a certain positive locking between the torque transfer element and the cylinder sleeve. However, the cylinder sleeve is clamped so tightly against the torque transfer element, that the torque transfer nevertheless primarily takes place by friction. Therefore, during the operation of the printing machine, the mechanical stress on the engaging dog is slight, so that wear and plastic or elastic deformation of the engaging dog is minimized. In this way, high precision can be achieved even in the long term when determining the angular position of the cylinder sleeve.

BRIEF DESCRIPTION OF THE DRAWINGS

In the following, examples of the invention are described in greater detail by means of the drawing, in which.

DETAILED DESCRIPTION

Figure 1:
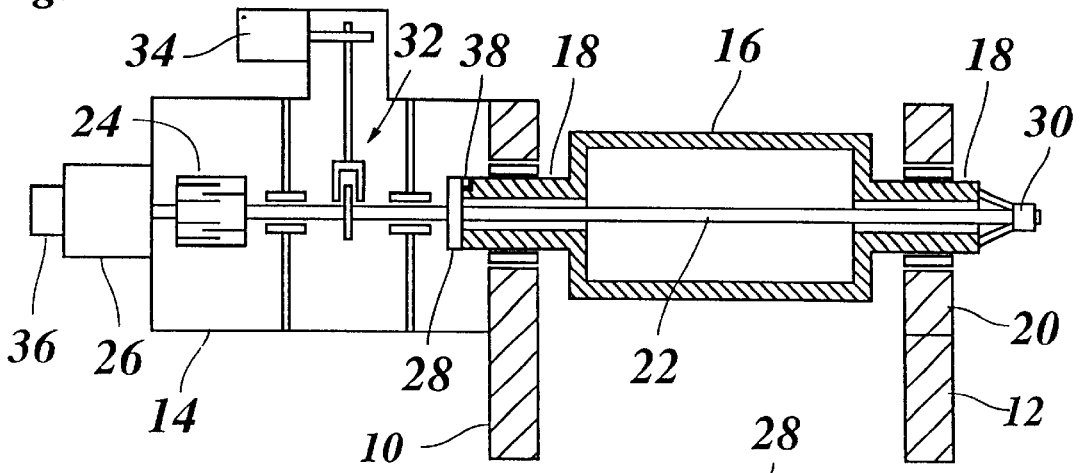
FIG. 1 shows a diagrammatic axial section through a cylinder sleeve of a printing machine with an associated driving mechanism and a lateral register adjustment device.

In FIG. 1, the frame of a printing machine, for example, a flexographic printing machine, is represented by two side parts 10 and 12, which are shown in section. A driving mechanism housing 14, which is shown only diagrammatically, is mounted on the side part 10. An exchangeable cylinder sleeve 16, for example, a printing cylinder sleeve, is mounted with axle journals 18, provided at each end, in the side parts 10 and 12. In the case of the side part 12, the bearing 20 for the cylinder sleeve 16 is removable. For example, this bearing 20 can be pulled axially from the axle journal 18 or the bearing is constructed as a tilting bearing with a bearing cover, which opens laterally, and can be moved on the side part 12 in the direction perpendicular to the plane of the drawing of FIG. 1, as described in EP-A-0 812 681.

In the gear housing 14, a shaft 22 is mounted, which extends coaxially through the cylinder sleeve 16 and is connected over an axial coupling 24 with the output shaft of a motor 26, rigidly held at the driving mechanism housing 14. A torque transfer element, in the form of flat friction disk 28, is seated rigidly on the shaft 22 and connected frictionally with the end face of the axle journal 18 of the cylinder sleeve 16, so that the driving torque of the motor 26 is transferred to the cylinder sleeve 16. At the free end, at the right in FIG. 1, the shaft 22 carries a clamping element 30, which engages the axle journal 18 there and presses the cylinder sleeve 16 firmly against the friction disk 28.

In the driving mechanism housing 14, a known adjusting mechanism 32 for adjusting the lateral register is installed. This adjusting mechanism 32 is actuated by a servo motor 34 and permits the unit, formed by the shaft 22, the cylinder sleeve 16 and the clamping element 30, to be adjusted axially. The relative movement between the shaft 22 and the output shaft of the motor 26 is compensated for by the axial coupling 24.

Figure 1A:
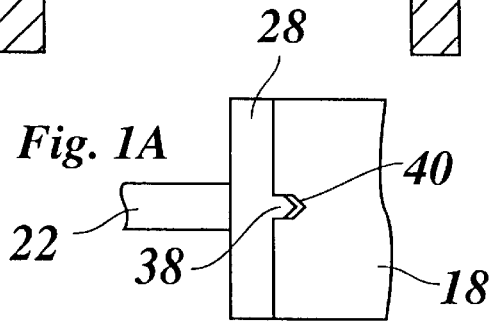
FIG. 1A shows an enlargement of a detail of FIG. 1.

The motor 26 has an angle sensor 36, which supplies a signal, which is representative of the angular position of the shaft 22 and is required for adjusting the longitudinal register. So that the signal of the angle sensor 36 is also representative of the angular position of the cylinder sleeve 16, the angular position of the cylinder sleeve 16 relative to the shaft 22 is fixed by an engaging dog 38, which is disposed at the outer periphery of the friction disk 28 and, in the form of a single tooth coupling, engages a corresponding recess 40 in the axle journal 18, as shown on an enlarged scale in FIG. 1A. The engaging dog 28 engages the recess 40 in the circumferential direction without clearance; however, in the axial direction, there is some clearance, so that slight, installation-required eccentricities between the shaft 22 and the cylinder sleeve 16 can be compensated for without the development of bending stresses in the shaft or the cylinder sleeve. In this way, it is ensured that the axis of rotation of the cylinder sleeve 16 is defined precisely by the mounting in the side parts 10 and 12, independently of any inaccuracies during the installation of the driving mechanism housing 14.

Figure 2:
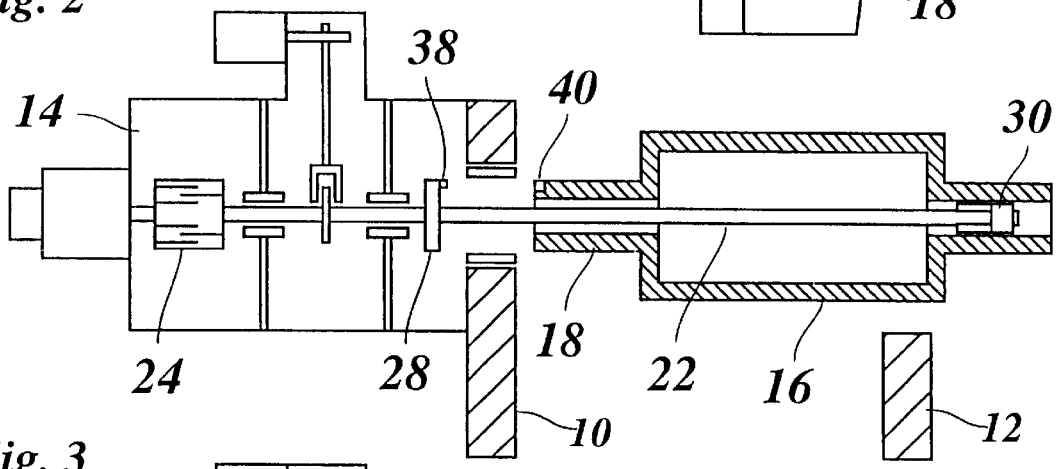
FIG. 2 shows a representation corresponding to FIG. 1 with, however, an intermediate stage during the exchange of the cylinder sleeve

FIG. 2 illustrates the procedure when exchanging the cylinder sleeve 16. It can be seen in FIG. 2 that the bearing 20 is removed on the side of the side part 12. In addition, the clamping element 30 is loosened. In the examples shown, the clamping element 30 is a component with expandable elements which, in the loosened state, lie tightly against the periphery of the shaft 22, so that the cylinder sleeve 16 can be pulled off over the clamping element axially from the shaft 22. The construction of the clamping element is described in detail in the older European patent application 98 110 132.

The new cylinder sleeve 16 is pushed once again over the clamping element 30 onto the shaft 22 until it comes into contact with the end side of its axle journal 18 at the friction disk 28. Moreover, the cylinder sleeve is aligned so that the engaging dog 38 can enter the recess 40. Due to the arrow-shaped sloping of the engaging dog, automatic precise adjustment of the angular position of the cylinder sleeve 16 in relation to the shaft 22 is attained. Subsequently, the clamping element 30 is expanded once again and clamped against the cylinder sleeve 16, so that the latter is pressed firmly against the friction disk 28. Finally, the bearing 20 is installed once again and, with that, the process of exchanging cylinders is concluded.

Figure 3:
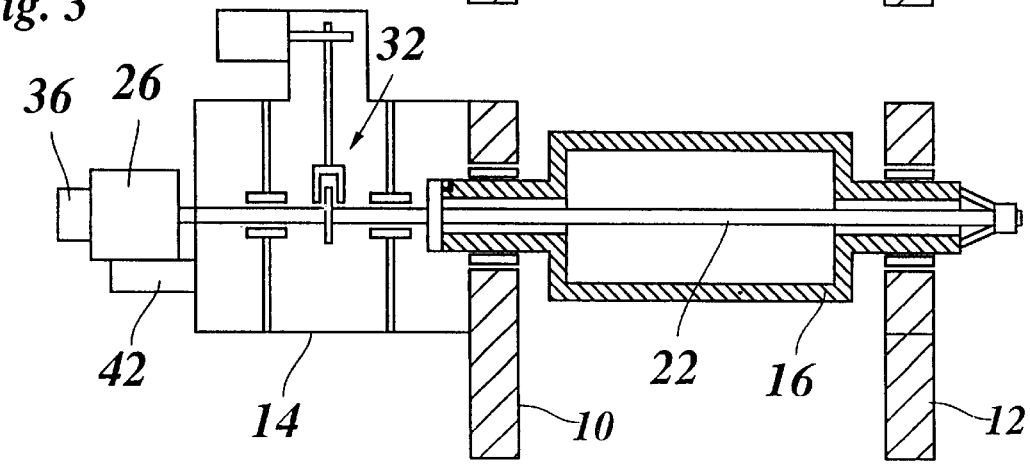
FIG. 3 shows a driving mechanism and lateral register adjustment device of a modified embodiment.

FIG. 3 shows a modified embodiment, for which the axial coupling 24 is omitted and the output shaft of the motor 26 is connected rigidly with the shaft 22 or is formed in one piece with the latter. The housing of the motor 26 and of the angle sensor 36 is held axially displaceable in this case, but non-rotatably on a bracket 42 of the driving mechanism housing and, during the adjustment of the lateral register, participates in the axial movement of the shaft 22 and the cylinder sleeve 16.

What is claimed is:

1. A printing machine comprising:

a rotatable cylinder sleeve which includes protruding axle journals at opposite ends thereof for supporting the cylinder sleeve directly in a machine frame, a shaft which passes through the cylinder sleeve and is driven along with the cylinder sleeve, with rotational driving taking place over the shaft, and a torque transfer element seated on the shaft and against which the cylinder sleeve is axially set such that the torque transfer element is effective to transfer torque from the shaft to the cylinder sleeve due to the cylinder sleeve being axially set against the torque transfer element.

2. The printing machine of claim 1, wherein the torque transfer element and the cylinder sleeve are clamped axially against one another, so that the torque transfer element forms a friction coupling with a respective axle journal of the cylinder sleeve facing said torque transfer element.

3. The printing machine of claim 2, further comprising a clamping element for clamping the cylinder sleeve against the torque transfer element, said clamping element being seated on the shaft.

4. The printing machine of claim 3, wherein the torque transfer element includes a flat friction disk.

5. The printing machine of claim 3, further comprising:

an angle sensor for use in determining an angular position of the shaft, at least one engaging dog in one of the torque transfer element and the respective axle journal of the cylinder sleeve, and at least one corresponding recess in the other of the torque transfer element and the respective axle journal for engaging with said at least one engaging dog in a circumferential direction, without clearance.

6. The printing machine of claim 3, further comprising an adjusting mechanism which engages the shaft for adjusting lateral register of said shaft.

7. The printing machine of claim 2, wherein the torque transfer element includes a flat friction disk.

8. The printing machine of claim 7, further comprising:

an engaging dog in one of the torque transfer element and the respective axle journal of the cylinder sleeve, and a recess in the other of the torque transfer element and the respective axle journal for engaging with said engaging dog in a circumferential direction, without clearance; and wherein the engaging dog forms a single tooth coupling with the recess, and has a clearance in a radial direction in the recess.

9. The printing machine of claim 8, further comprising an adjusting mechanism which engages the shaft for adjusting lateral register of said shaft.

10. The printing machine of claim 7, further comprising:

an angle sensor for use in determining an angular position of the shaft, at least one engaging dog in one of the torque transfer element and the respective axle journal of the cylinder sleeve, and at least one corresponding recess in the other of the torque transfer element and the respective axle journal for engaging with said at least one engaging dog in a circumferential direction, without clearance.

11. The printing machine of claim 7, further comprising an adjusting mechanism which engages the shaft for adjusting lateral register of said shaft.

12. The printing machine of claim 2, further comprising:

an angle sensor for use in determining an angular position of the shaft, an engaging dog in one of the torque transfer element and the respective axle journal of the cylinder sleeve, and a corresponding recess in the other of the torque transfer element and the respective axle journal for engaging with said engaging dog in a circumferential direction, without clearance.

13. The printing machine of claim 12, wherein the engaging dog forms a single tooth coupling with the recess, and has a clearance in a radial direction in the recess.

14. The printing machine of claim 12, further comprising an adjusting mechanism which engages the shaft for adjusting lateral register of said shaft.

15. The printing machine of claim 1, further comprising an adjusting mechanism which engages the shaft for adjusting lateral register of said shaft.

16. The printing machine of claim 15, further comprising:

a motor for driving the shaft, said motor including an output shaft, and an axial coupling for connecting the motor with the shaft, and which compensates for relative axial movements between the shaft and the output shaft of the motor.

17. The printing machine of claim 15, further comprising:

a motor having an output shaft for driving the shaft and which is connected rigidly with said shafts, and a housing for said motor held non-rotatably and axially displaceable at the machine frame.

18. The printing machine of claim 2, further comprising an adjusting mechanism which engages the shaft for adjusting lateral register of said shaft.

* * * * *